US007806279B2

(12) United States Patent
Kubota

(10) Patent No.: US 7,806,279 B2
(45) Date of Patent: Oct. 5, 2010

(54) ENGAGEMENT MEMBER FOR DISPLAY DEVICE

(75) Inventor: Harunobu Kubota, Ichikawa (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 605 days.

(21) Appl. No.: 11/793,964

(22) PCT Filed: Dec. 13, 2005

(86) PCT No.: PCT/JP2005/022814

§ 371 (c)(1),
(2), (4) Date: Jun. 25, 2007

(87) PCT Pub. No.: WO2006/067999

PCT Pub. Date: Jun. 29, 2006

(65) Prior Publication Data

US 2008/0047910 A1 Feb. 28, 2008

(30) Foreign Application Priority Data

Dec. 24, 2004 (JP) ..... 2004-373054

(51) Int. Cl.
*A47F 7/00* (2006.01)

(52) U.S. Cl. ..... 211/94.01

(58) Field of Classification Search ..... 211/94.01, 211/87.01, 189, 162; 248/220.41; 52/506.01, 52/510

See application file for complete search history.

(56) References Cited

U.S. PATENT DOCUMENTS 2,291,966 A * 8/1942 Joseph ..... 248/215
4,352,478 A * 10/1982 Loew ..... 248/222.11
4,678,151 A * 7/1987 Radek ..... 248/223.41
4,700,846 A * 10/1987 Schroder ..... 211/41.17
4,736,855 A * 4/1988 Arakawa ..... 211/94.01
4,942,498 A * 7/1990 Toussaint ..... 361/709

(Continued)

FOREIGN PATENT DOCUMENTS

JP 60-97064 7/1985

(Continued)

OTHER PUBLICATIONS

International Search Report for PCT/JP2005/022814 w/ English translation mailed Mar. 28, 2006 (2 pages).

(Continued)

*Primary Examiner*—Sarah Purol
(74) *Attorney, Agent, or Firm*—Osha Liang LLP

(57) ABSTRACT

A first engagement part 4 removably engaged with an engagement part 1*c* of a panel 1 is disposed at an upper end of a main body part 3 of a engagement member 2. A second engagement part 5 is disposed at a lower end of the main body part 3. An elastic element part 5*b* is engaged with the engagement part 1*c* by its own elasticity, thereby the second engagement part 5 is removably engaged with the engagement part 1*c*. A control part 3*c* extending downwardly is disposed at the lower end of the main body part 3. For removing the engagement member 2 from the panel 1, the lower end of the main body part 3 is moved in a direction away from the panel 1 by hooking a finger on the control part 3*c*.

6 Claims, 11 Drawing Sheets

U.S. PATENT DOCUMENTS

| | | | | |
|---|---|---|---|---|
| 5,101,989 | A * | 4/1992 | Jones | 211/94.01 |
| 5,121,578 | A * | 6/1992 | Holz | 52/506.01 |
| 5,390,462 | A * | 2/1995 | Kreiter | 52/506.05 |
| 6,113,201 | A * | 9/2000 | Bauer | 312/245 |
| 6,119,878 | A * | 9/2000 | Zen | 211/94.01 |
| 6,134,846 | A * | 10/2000 | Lamb | 52/36.5 |
| 6,199,705 | B1 * | 3/2001 | Portner | 211/26 |
| 6,393,877 | B1 * | 5/2002 | Church | 70/62 |
| 6,811,043 | B2 * | 11/2004 | Perkins et al. | 211/94.01 |
| 6,971,614 | B2 * | 12/2005 | Fischer et al. | 248/220.43 |
| 7,228,977 | B2 * | 6/2007 | Perkins et al. | 211/94.01 |
| 2007/0181517 | A1 * | 8/2007 | Perkins et al. | 211/94.01 |

FOREIGN PATENT DOCUMENTS

| | | |
|---|---|---|
| JP | 62-211014 | 9/1987 |
| JP | 7-255573 | 10/1995 |

OTHER PUBLICATIONS

Patent Abstracts of Japan 07-255573 dated Oct. 9, 1995 (2 pages).

* cited by examiner

ENGAGEMENT MEMBER FOR DISPLAY DEVICE

TECHNICAL FIELD

This invention relates to an engagement member used in a display device for displaying various merchandise items such as clothes, and other items.

BACKGROUND ART

In general, a display device includes a panel (base material) fixed to a vertical wall surface and an engagement member removably attached to a front surface of the panel. A plurality of engagement parts are formed on the front surface of the panel in a vertical relation with a predetermined space. The engagement member includes a main body part having a predetermined length in a vertical direction, an engagement part disposed at an upper end of the main body part and removably engaged with the engagement part and an elastic element disposed at a lower end of the main body part. The elastic element is removably engaged with the engagement part by its own elasticity. Owing to the foregoing arrangement, the engagement member is elastically removably connected to the panel (see Patent Documents 1 and 2).

Patent Document 1: Japanese Utility Model Application Laid-Open No. S60-97064

Patent Document 2: Japanese Patent Application Laid-Open No. H07-255573

DISCLOSURE OF THE INVENTION

Problem to be Solved by the Invention

Since the elastic element of the conventional engagement member is engaged with the panel by its elasticity, the engagement member must be removed from the panel against elasticity of the elastic element. Thus, the engagement member is difficult to be removed from the panel.

Means for Solving the Problem

According to the present invention, there is provided an engagement member for a display device comprising a main body part having a predetermined length in a vertical direction, an engagement part disposed either at an upper or lower end of the main body part and removably engaged with a front surface part of a base material, and connection means for removably elastically connecting the other upper or lower end of the main body part to the front surface of the base material, CHARACTERIZED in that one of the main body part and the connection means is provided with a control part manually controlled for releasing connection of the connection means with the base material.

The connection means is preferably disposed at the other upper or lower end of the main body part.

It is preferable that the connection means is an elastic element integrally disposed at the main body part, the elastic element is removably connected to the base material by its own elasticity, thereby the other end of the main body part is elastically removably connected to the base material, and the control part is integrally disposed at the main body part.

At least a tip part of the control part is preferably disposed forward of a position where the elastic element is engaged with the base material in a direction toward the elastic element from the engagement part.

It is preferable that the connection means includes a displacement member disposed at the main body part such that the displacement member is displaceable between an engaging position where the main body part is engaged with the base material and a releasing position away from the base material and biasing means for biasing the displacement member toward the engaging position from the releasing position, the displacement member is brought into engagement with the base material by biasing force of the biasing means, thereby the other end of the main body part is elastically removably connected to the base material, and the displacement member is provided with the control part.

It is preferable that the connection means includes a first connection member removably engaged with the base material, a second connection member disposed at the first connection member such that the second connection member is turnable between a first turning position where the second connection member is engaged with the main body part and a second turning position away from the main body part and a turn biasing means for biasing the second connection member toward the first turning position from the second turning position, the second connection member is brought into engagement with the main body part by biasing force of the turn biasing means, thereby the other end of the main body part is elastically removably connected to the base material, and the second connection member is provided with the control part.

Effect of the Invention

According to the present invention having the above-mentioned characteristic construction, since the control part can be held by hand at the time of removing the engagement member from the base material, the engagement member can easily be removed from the base material against elastic force.

BRIEF DESCRIPTION OF DRAWINGS

FIG. 4(A) is a front view thereof, FIG. 4(B) is a rear view thereof and FIG. 4(C) is a view when viewed in a direction as indicated by an arrow C of FIG. 4(A).

FIG. 8(A) is a side view in which a turnable member is turned to an engaging position and FIG. 8(B) is a side view in which the turnable member is turned to a releasing position.

FIG. 9(A) is a side view in which a turnable member is turned to an engaging position and FIG. 9(B) is a side view in which the turnable member is turned to a releasing position.

FIG. 10(A) is a side view in which a movable member is moved to an engaging position and FIG. 10(B) is a side view in which the movable member is moved to a releasing position.

FIG. 11(A) is a side view in which a second connection member is turned to an engaging position and FIG. 11(B) is a side view in which the second connection member is turned to a releasing position.

DESCRIPTION OF REFERENCE NUMERAL

Figure 1:
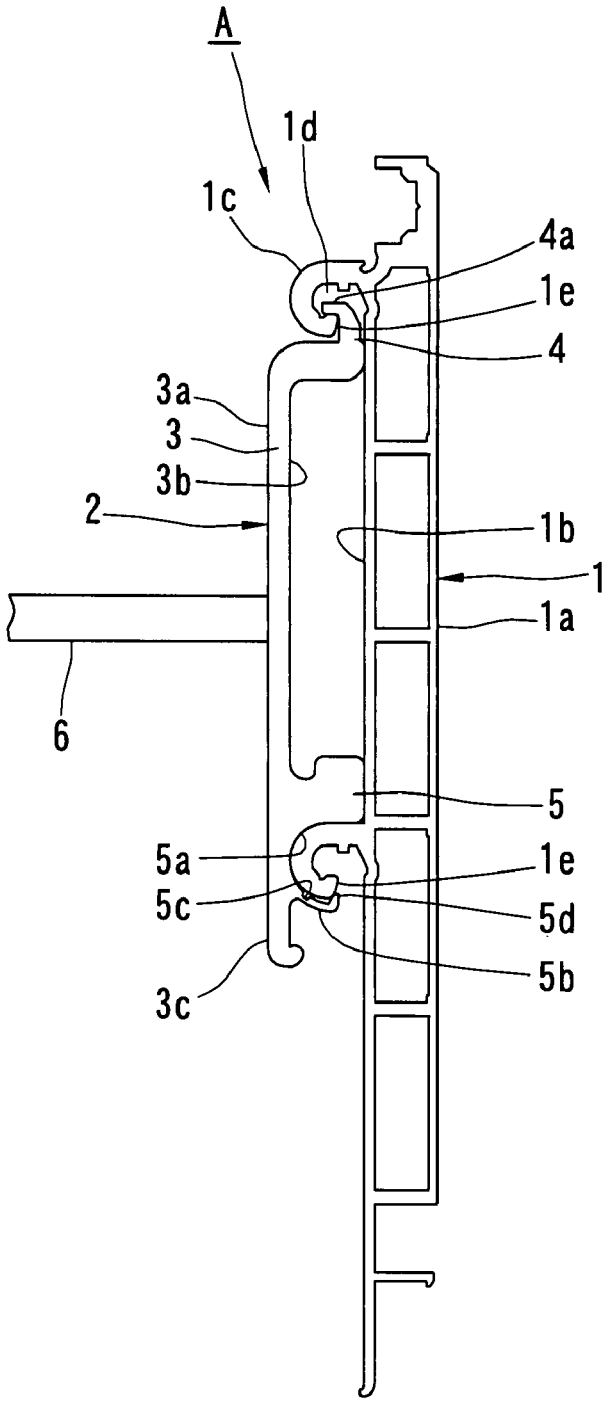
FIG. 1 is a side view of a first embodiment of the present invention in which an engagement member is located in an attaching position.

A, B, C, D, E, F, F', G, H . . . display device
1 . . . panel (base material)
1*b* . . . front surface
1*c* . . . engagement part
1*e* . . . tip surface
2 . . . engagement member
3 . . . main body part
3*c* . . . control part
3*d* . . . abutment surface
4 . . . first engagement part (engagement part)
5*b* . . . elastic element part (connection means)
5*d* . . . protrusion part
8 . . . connection mechanism (connection means)
9 . . . connection mechanism (connection means)
10 . . . connection mechanism (connection means)
81 . . . turning member (displacement member)
81' . . . turning member (displacement member)
81*a* . . . abutment surface
81*b* . . . control part
81*c* . . . control part
83 . . . spring (biasing means)
91 . . . movable member (displacement member)
91*a* . . . abutment surface
91*b* . . . control part
92 . . . spring (biasing means)
101 . . . first connection member
102 . . . second connection member
102*a* . . . control part
102*b* . . . abutment surface
103 . . . spring (turn biasing means)

BEST MODE FOR CARRYING OUT THE INVENTION

The best mode for carrying out the present invention will be described hereinafter with reference to the drawings.

Figure 2:
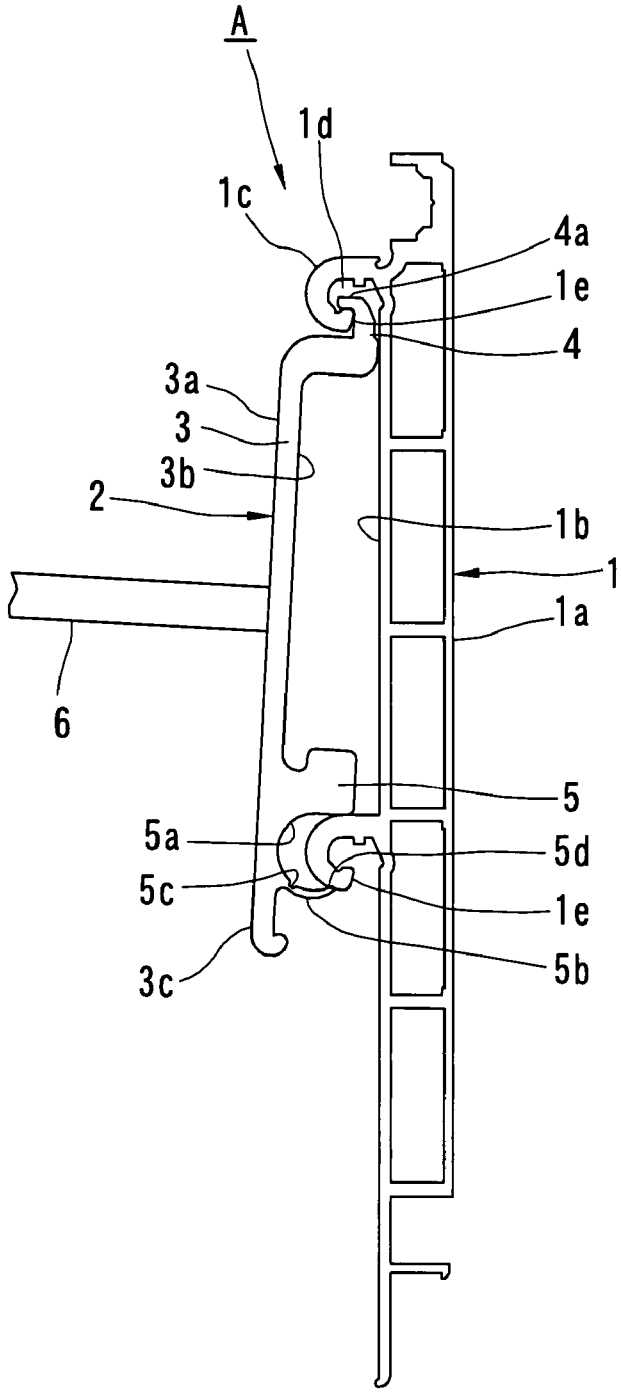
FIG. 2 is a side view of the above embodiment in which a protrusion part is abutted with an engagement part.

FIGS. 1 and 2 show a first embodiment of the present invention. A display device A according to the first embodiment comprises a panel (base material) 1 and an engagement member 2.

The panel 1 is formed in a flat plate by an aluminum die material. Of course, the panel 1 may be formed of other plate material such as, for example, a plate material or a hollow plate material made of synthetic resin such as polyethylene, or a cosmetic plate made of wood. The panel 1 is vertically arranged and its rear surface (right surface in FIG. 1) 1*a* is fixed to a vertical wall surface (not shown). A plurality of engagement parts 1*c* extending horizontally in a left and right direction are formed on a vertical front surface 1*b* of the panel 1. The respective engagement parts 1*c* are arranged at constant intervals in a vertical direction. A tip part of each engagement part 1*c* is bent downwardly in a generally semicircular configuration. Thus, an engagement recess 1*d* is defined by the front surface 1*b* of the panel 1 and the engagement part 1*c*. A lower end of this engagement recess 1*d* on the panel 1 side is externally downwardly opened.

The engagement member 2 includes a main body part 3, a first engagement part (engagement part) 4 and a second engagement part 5. The main body part 3 is formed in a flat plate-like configuration from aluminum, synthetic resin, wood or the like. The left and right length and the vertical length of the main body part 3 are properly determined depending on for what purpose the engagement member 2 is to be used. The main body part 3 is provided at a front surface 3*a* thereof with a support member 6. This support member 6 is formed in a suitable configuration depending on for what purpose it is to be used. For example, in case a hunger (not shown) is hang on the support member 6 or the support member 6 supports one end of a horizontal rack board, the support part 6 is formed in a rod-like configuration. In case the support member 6 itself is a rack board, it is formed as a flat plate extending in the left and right direction. Although the support member 6 is formed in the front surface 3*a* of the main body part 3 in the embodiments to be described hereinafter, it is not shown in any drawing for those embodiments excepting the present embodiment.

The first engagement part 4 is formed on an upper end of a rear surface 3*b* of the main body part 3 in such a manner as to protrude toward the panel 1. The left and right length of the first engagement member 4 is set equal to the left and right length of the main body 3. But the former may be set shorter than the latter. In case the left and right length of the first engagement member 4 is set shorter than that of the main body 3, it is also accepted that a plurality of first engagement parts 4 are formed and they are mutually spacedly arranged in the left and right direction. As shown in FIG. 1, the height (protruding amount from the main body part 3 toward the panel 1) of the first engagement member 4 is determined such that when the engagement member 2 is attached to the panel 1 with the main body part 3 kept generally parallel to the panel 1 (the position occupied by the engagement member 2 at that time shall be hereinafter referred to as the attaching position), a tip surface of the first engagement part 4 is almost contacted with the front surface 1*b* of the panel 1.

An engagement claw part 4*a*, which protrudes upwardly from the first engagement part 4 and whose tip end is bent at an approximately right angle in a direction away from the panel 1, is formed on the panel 1 side end of the upper surface of the first engagement part 4. This engagement claw 4*a* can be inserted into the engagement recess Id through its open part in the following manner. First, the main body part 3 is inclined upwardly to the right in FIG. 1 at a proper angle so that a lower end of the main body part 3 is more separated from the panel 1 than the upper end. Then, while maintaining the inclined state, the entire engagement member 4 is translated upwardly along the panel 1. By doing so, the engagement claw part 4*a* can be inserted into the engagement recess 1*d* through its open part at its end (the position occupied by the engagement member 2 at that time shall be hereinafter referred to as the removing position). In the removing position, the main body part 3 is turnable about the open part of the engagement recess 1*d* so that the lower end of the main body part 3 is brought toward the panel 1. When the main body part 3 is turned until the tip surface of the first engagement part 4 is brought nearly into contact with the front surface 1*b* of the panel 1, the engagement member 1 reaches the attaching position. When the engagement member 1 reaches the attaching position, the tip part of the engagement claw part 4*a* is brought into engagement with the tip part of the engagement part 1*c* facing the engagement recess 1*d*. By engagement between the engagement claw part 4*a* and the engagement part 1*c*, the upper end of the engagement member 2 is prohibited from moving forwardly and downwardly. Backward movement of the engagement member 2 is prohibited by abutment of the first engagement part 4 with the front surface 1*b* of the panel 1. By turning the engagement member 2 from the attaching position to the removing position, engagement of the engagement claw part 4*a* with the engagement part 1*c* can be released. Thereafter, the engagement claw part 4*a* can be removed from the engagement recess 1*d* by translating the engagement member 2 downwardly from the removing position.

The second engagement part 5 is formed on a lower end of the rear surface 3*b* of the main body part 3 in such a manner as to protrude toward the panel 1. The left and right length of the second engagement part 5 may be equal to or shorter than the left and right length of the main body part 3 as in the case with the first engagement part 4. Of course, in case the left and right length of the second engagement part 5 is shorter than the left and right length of the main body part 3, a plurality of second engagement parts 5 may be mutually spacedly arranged in the left and right directions. The height of the second engagement part 5 is set equal to the height of the first engagement part 4.

An engagement recess 5*a* is formed in a tip surface (surface opposing the panel 1) of the second engagement part 5. The configuration of the engagement recess 5*a* is determined such that when the engagement member 2 is located at the attaching position, the entire engagement part 1*c* (this engagement part 1*c* is adjacent to the lower side of the engagement part 1*c* with which the engagement claw part 4*a* of the first engagement part 4 is engaged) is fitted into the engagement recess 5*a*. The end part of the engagement recess 5*a* on the open side (panel 1 side) is opened downwardly.

A lower side end of the second engagement part 5 is thin because the engagement recess 5*a* is arranged below the center of the second engagement part 5 in the vertical direction, and the lower end is provided as an elastic element part (connection means) 5*b*. This elastic element part 5*b* is formed in an arcuate configuration generally along the outer surface of a tip part (lower end) of the engagement part 1*c*. A groove part 5*c* is formed in the surface of a basal end of the elastic element part 5*b* opposing the engagement part 1*c*. Formation of the groove part 5*c* makes it possible for the elastic element part 5*b* to be elastically deformed so that its distal end is turned and displaced in the direction (vertical direction in this embodiment) toward and away from the engagement part 1*c*. A protrusion part 5*d* protruding upwardly toward the inside of the engagement recess 1*d* is formed on the distal end of the elastic element part 5*b*. This protrusion part 5*d*, when the engagement member 2 is located at the attaching position, is engaged with the engagement part 1*c* by elastic force of the elastic element part 5*b*. That is, the side part of the protrusion part 5*d* on the reverse side of the panel 1 is pressure-contacted with the tip surface 1*e* of the engagement part 1*c* opposing the panel 1 by elastic force of the elastic element part 5*b*.

When the engagement member 2 is located at the attaching position, forward movement (movement in the direction away from the panel 1) of the upper end of the engagement member 2 is prohibited by engagement between the engagement part 1*c* and the first engagement part 4 and forward movement of the lower end of the engagement member 2 is prohibited by engagement between the engagement part 1*c* and the second engagement part 5 (engagement between the engagement part 1*c* and the protrusion part 5*d* of the elastic element part 5*b*), thereby forward movement of the engagement member 2 is prohibited. Vertical movement of the engagement member 2 is prohibited by holding the engagement part 1*c* between the protrusion part 5*d* and the side surface on the upper side of the engagement recess 5*a* and/or holding the two engagement parts 1*c*, 1*c* between the protrusion part 5*d* and the engagement claw part 4*a* of the first engagement part 4. Furthermore, movement of the engagement member 2 in the left and right direction is prohibited by frictional resistance between the engagement part 1*c* and the protrusion part 5*d* and between the engagement part 1*c* and the side surface of the engagement recess 5*a*, and/or between the engagement part 1*c* and the protrusion part 5*d* and between the engagement part 1*c* and the engagement claw part 4*a*. The engagement member 2 is attached to the panel 1 at the attaching position as in the manner mentioned above.

Although the protrusion part 5*d* is engaged with the tip part of the engagement part 1*c* by elasticity of the elastic element part 5*b*, engagement of the protrusion part 5*d* with the engagement part 1*c* can be released by applying force having a magnitude larger than a predetermined magnitude to the lower end of the engagement member 2 forwardly. That is, since the tip surface 1*e* of the engagement part 1*c* is inclined toward the panel 1 as it goes upwardly, the protrusion part 5*d* is pushed downwardly by the tip surface 1*e* when force having a magnetude larger than a predetermined magnitude is applied to the lower end of the engagement member 2 forwardly. In case this pushing force is larger than the elastic force of the elastic element part 5*b*, the protrusion part 5*d* is slid on the tip surface 1*e* downwardly. When the protrusion part 5*d* is escaped downwardly from the tip surface 1*e*, engagement between the protrusion part 5*d* and the tip surface 1*e* is released. That is, engagement between the second engagement part 5 and the engagement part 1*c* is released. As a result, the lower end of the engagement member 2 becomes movable forwardly.

A control part 3*c* projecting downwardly from a lower end surface of the main body part 3 is formed on the main body part 3. This control part 3*c* is used at the time of moving the lower end of the main body part 3 forwardly and the length of the control part 3*c* is set such that the control part 3*c* can be pulled forwardly by hooking a finger thereon. Particularly, in this embodiment, the length of the control part 3*c* is set such that a tip part (lower end) of the control part 3*c* is located below a position where the protrusion part 5*d* and the engagement part 1*c* is engaged, i.e., a position where the protrusion part 5*d* and the tip surface 1*e* are contacted with each other.

In order to attach the engagement member 2 to the panel 1 in the display device A thus constructed, the engagement member 2 is brought to a posture which the engagement member 2 takes in the removing position and the engagement claw part 4*a* is brought into an opposing relation to the open part of the engagement recess 1*d*. Then, the engagement member 2 is translated upwardly to the removing position and tip part of the engagement claw part 4*a* is inserted into the engagement recess 1*d*. Thereafter, the engagement member 2 is moved from the removing position to the attaching position. By doing so, the first engagement part 4 is engaged with the engagement part 1*c*. During the process for turning the engagement member 2 from the removing position to the attaching position, the protrusion part 5*d* is abutted with an outer surface on the lower side of the engagement part 1*c* as shown in FIG. 2. When the engagement member 2 is further turned toward the attaching position in that state, the protrusion part 5*d* is moved downwardly against elasticity of the elastic element part 5*b* by the outer surface of the engagement part 1*c*. The protrusion part 5*d* passes over the outer surface of the engagement part 1*c* immediately before the engagement member 2 reaches the attaching position. Then, the protrusion part 5*d* is moved upwardly by elasticity of the elastic element part 5*b* and abutted with the tip surface 1*e* of the engagement part 1*c*. By doing so, the second engagement part 5 is engaged with the engagement part 1*c*. When the first and second engagement parts 4, 5 are engaged with the engagement parts 1*c*, 1*c* respectively, the engagement member 2 is attached to the panel 1.

In order to remove the engagement member 2 from the panel 1, first, the lower end of the engagement member 2 is moved forwardly. At that time, by hooking a finger on the control part 3*c*, the lower end of the engagement member 2 can easily be moved forwardly. Moreover, in this embodiment, since the tip part of the control part 3*c* is located forward of the contacting position between the protrusion 5*d* and the tip surface 1*e* of the engagement part 1*c* in the direction toward the second engagement part 5 from the first engagement part 4, the lower end of the engagement member 2 can more easily be moved forwardly. That is, to move the lower end of the engagement member 2 forwardly means that the second engagement part 5 is turned clockwise, in FIG. 1, generally about the first engagement part 4, serving the first engagement part 4 as a fulcrum, the contacting position between the protrusion part 5*d* and the tip surface 1*e* as an acting point and the control part 3*c* as a force point. Therefore, presuming that the control part 3*c* is formed between the first engagement part 4 and the second engagement part 5, it is necessary to act a large force on the control part 3*c* in order to separate the protrusion part 5*d* from the tip surface 1*e*. Thus, it becomes difficult to move the lower end of the engagement member 2 forwardly. In this respect, since the length of the control part 3*c* is set such that the tip part of the control part 3*c* is located below the contacting position between the protrusion part 5*d* and the tip surface 1*e* of the engagement part 1*c* in this embodiment, the protrusion part 5*d* can be separated from the tip surface 1*e* by acting only a small force on the control part 3*c*. Accordingly, the lower end of the engagement member 2 can easily be moved forwardly against elasticity of the elastic element part 5*b*.

After the lower end of the engagement member 2 is moved forwardly until the engagement member 2 reaches the removing position, the engagement member 2 is translated downwardly and the engagement claw part 4*a* is removed from the engagement recess 1*d*. By doing so, the engagement member 2 can be removed from the panel 1. Since the second engagement part 5 is separated forwardly from the engagement part 1*c* when the engagement member 2 is located at the removing position, the second engagement part 2 is not brought into abutment with the engagement part 1*c* when the engagement member 2 is moved downwardly.

Other embodiments of the present invention will be described next. In the embodiments to be described hereinafter, only those components different from those of the first embodiment are described, and those components identical with those of the first embodiment are denoted by identical reference numerals and description thereof is omitted.

Figure 3:
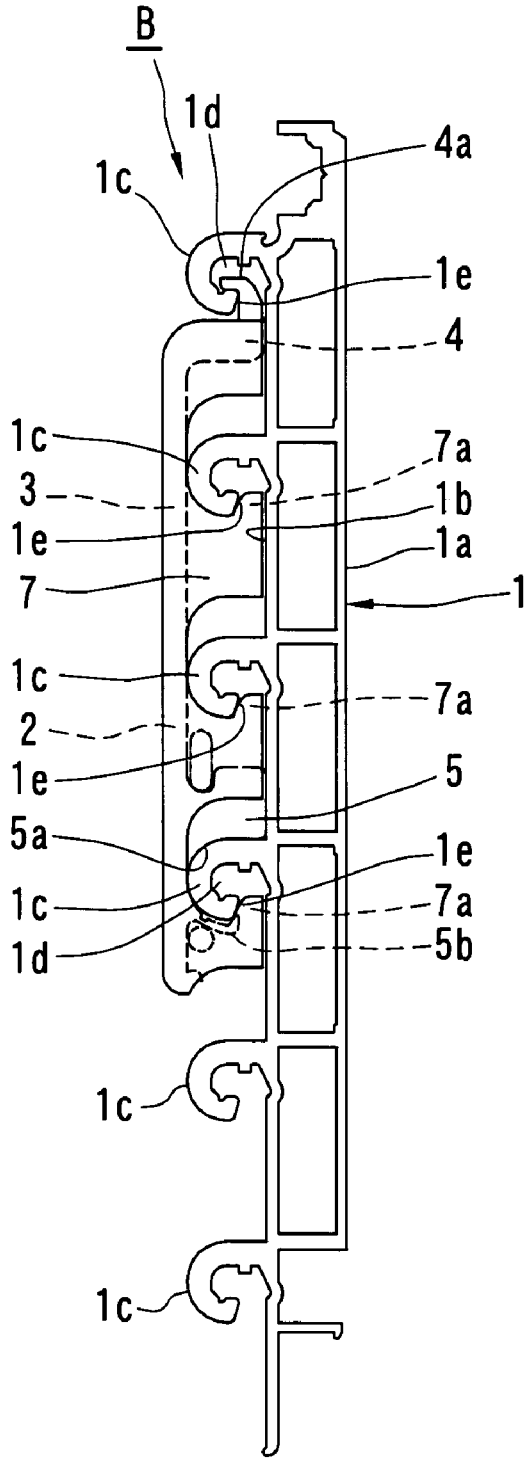
FIG. 3 is a side view showing a second embodiment of the present invention.
Figure 4:
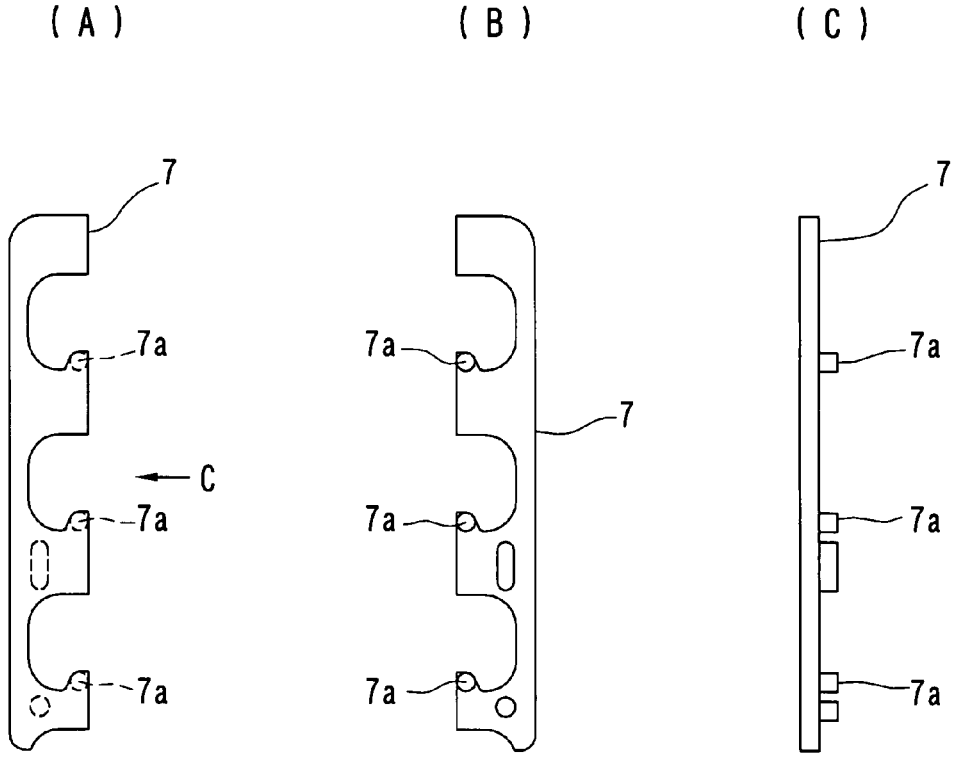
FIG. 4 is a view showing a lock member used in the second embodiment.

FIG. 3 shows a second embodiment of the present invention. In a display device B of the second embodiment, the vertical space of the engagement part 1*c* is smaller than that of the first embodiment, and the space between the two engagement parts 1*c*, 1*c* is set such that the two engagement parts 1*c*, 1*c* are inserted between the first engagement part 4 and the second engagement part 5. A lock member 7 is removably attached to at least one of the left and right sides of the engagement member 2. The lock member 7, when attached to the engagement member 2, is movable in a removing direction with respect to the engagement member 2 but it is non-movable in any other direction with respect to the engagement member 2. The lock member 7, as shown in FIG. 4, is in the shape of a flat plate and provided at its surface opposing the engagement member 2 with a plurality of projections 7*a*. The respective projections 7*a* are arranged in such a manner as to be abutted with the tip surface of the engagement part 1*c* when the lock member 7 is attached to the engagement member 2. Accordingly, in this display device B, the engagement member 2 is non-removable from the panel 1 unless the lock member 7 is removed from the engagement member 2.

Figure 5:
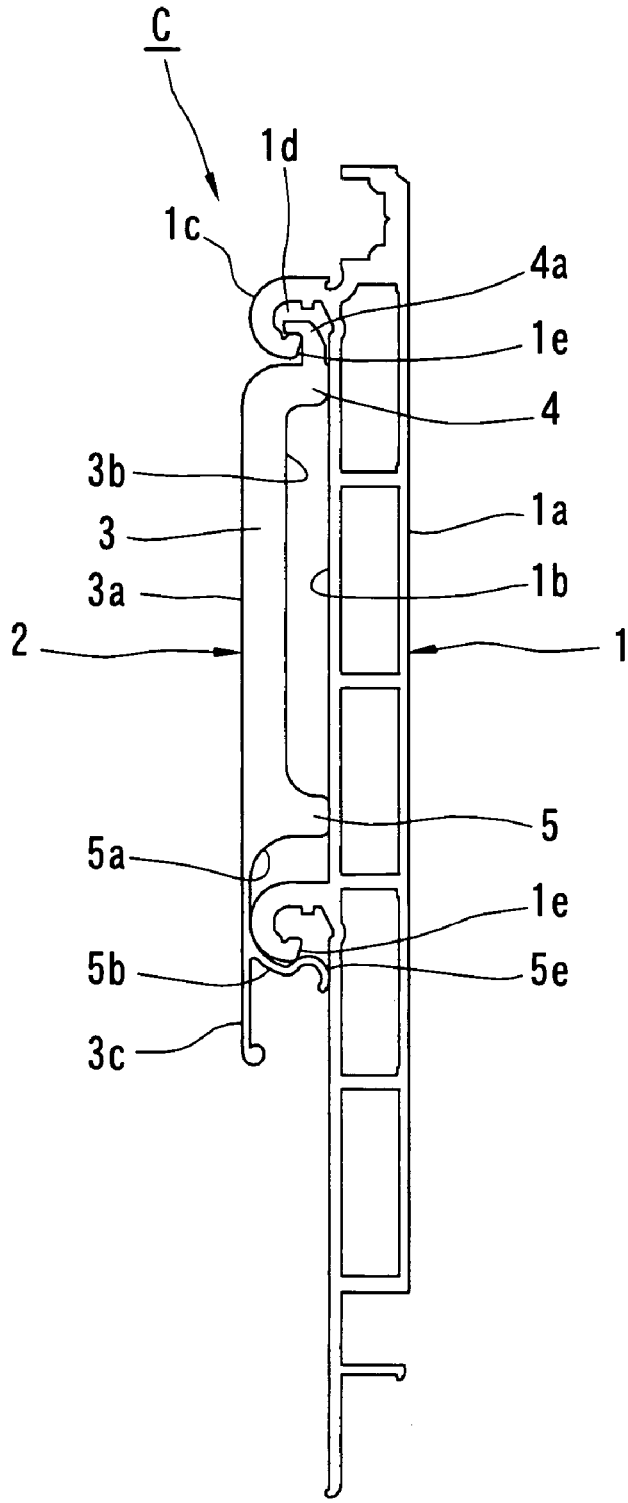
FIG. 5 is a side view showing a third embodiment of the present invention.

FIG. 5 shows a third embodiment of the present invention. In a display device C of the third embodiment, a lower end of the main body part 3 facing nearly a half of the lower side of the engagement recess 5*a* is in the shape of a thin plate. This plate-shaped part serves as the elastic element part 5*b*. Accordingly, the elastic element part 5*b* of the third embodiment is longer than the elastic element part 5*b* of the first embodiment shown in FIGS. 1 and 2. As a result, the elastic element part 5*b* has elasticity although it has no groove part 5*c*. A nearly semi-circular bent part 5*e*, instead of the protrusion part 5*d*, is formed on the distal end of the elastic element part 5*b*. This bent-part 5*e* is abutted with the tip surface 1*e* by elasticity of the elastic element part 5*b*. The vertical width of the engagement recess 5*a* is larger than the vertical width of the engagement part 1*c*, so that an inner surface of an upper half part of the engagement recess 5*a* is separated from the engagement part 1*c* when the engagement member 2 is located at the attaching position. Accordingly, in the display device C of the third embodiment, the engagement claw part 4*a* and the elastic element part 5*b* sandwichingly hold the two engagement parts 1*c*, 1*c*. The control part 3*c* is branched from the basal end of the elastic element part 5*b* and allowed to extend downwardly. That is, the control part 3*c* and the elastic element part 5*b* commonly include a basal end.

Figure 6:
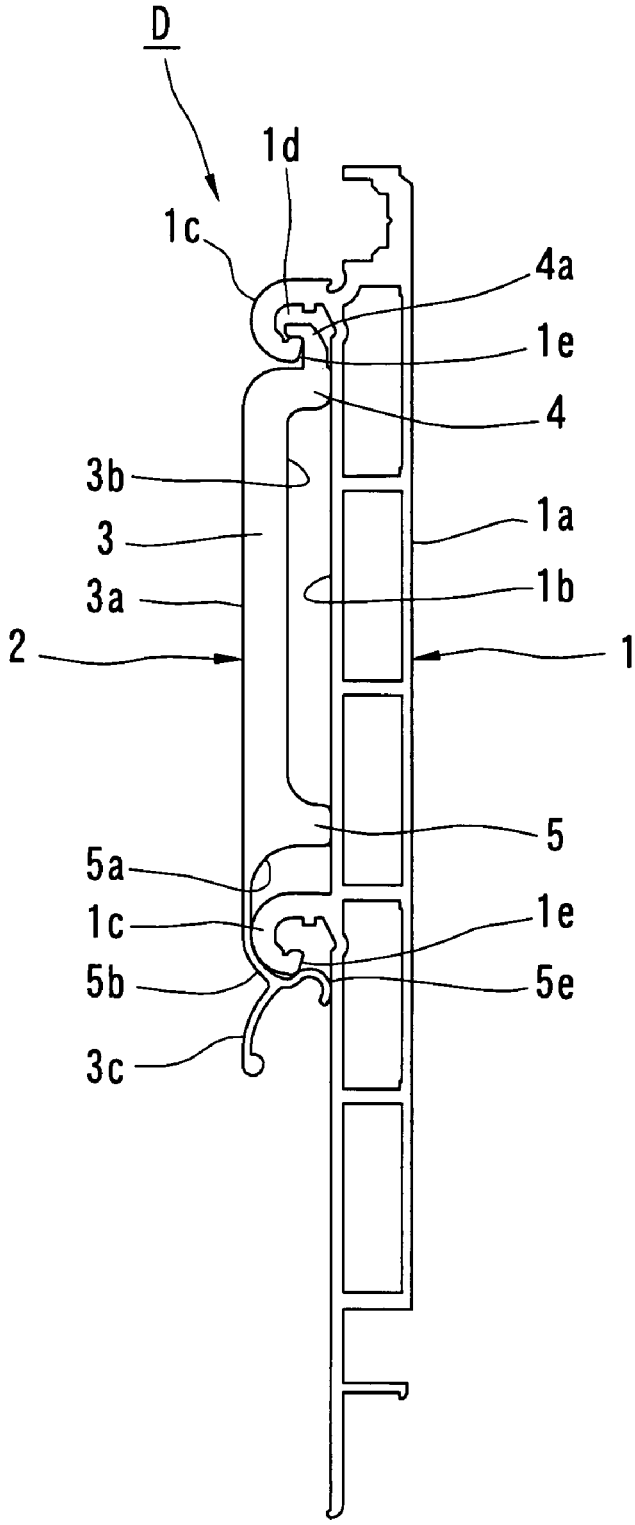
FIG. 6 is a side view showing a fourth embodiment of the present invention.

FIG. 6 shows a fourth embodiment of the present invention. In a display device D of the fourth embodiment is a modification of the display device C shown in FIG. 5. In this display device D, the control part 3*c* is integrally formed with an intermediate part of the elastic element part 5*b* and allowed to extend downwardly from the intermediate part of the elastic element part 5*b*.

Figure 7:
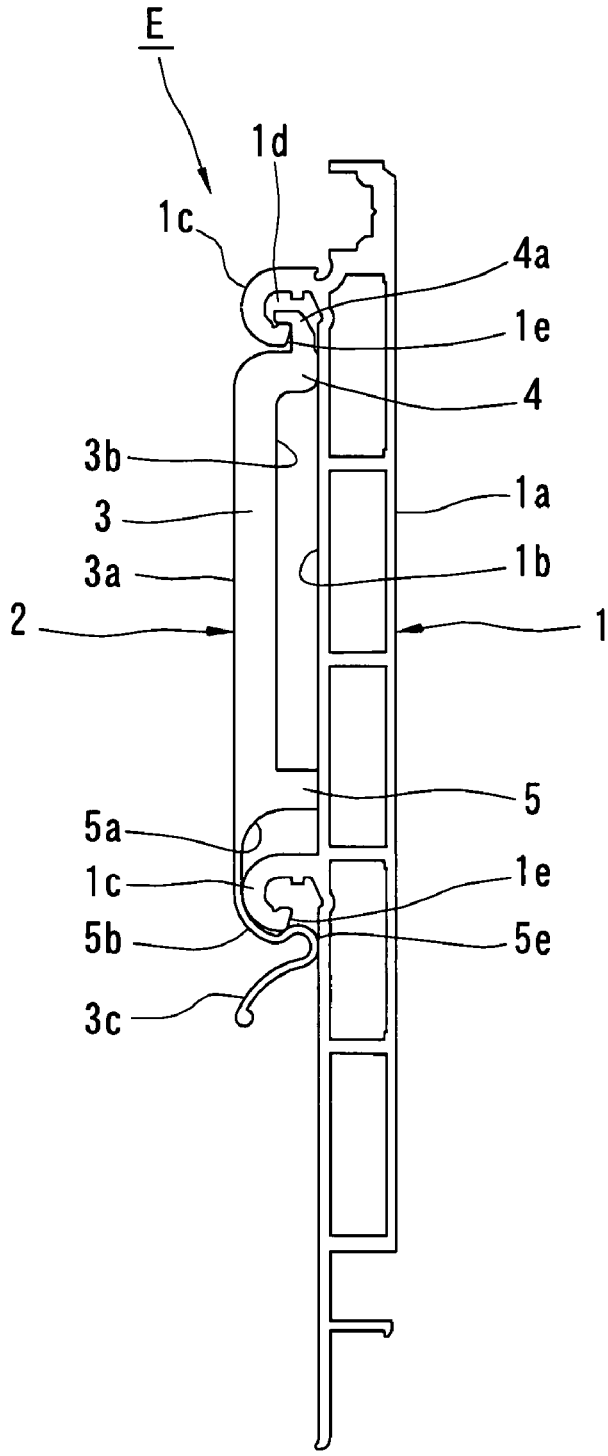
FIG. 7 is a side view showing a fifth embodiment of the present invention.

FIG. 7 shows a fifth embodiment of the present invention. In a display device E of the fifth embodiment is a modification of the display device C shown in FIG. 5. In this display device E, the control part 3*c* is integrally formed with a tip part of the bent-part 5*e* and allowed to extend downwardly from the tip part of the bent-part 5*e*.

Figure 8:
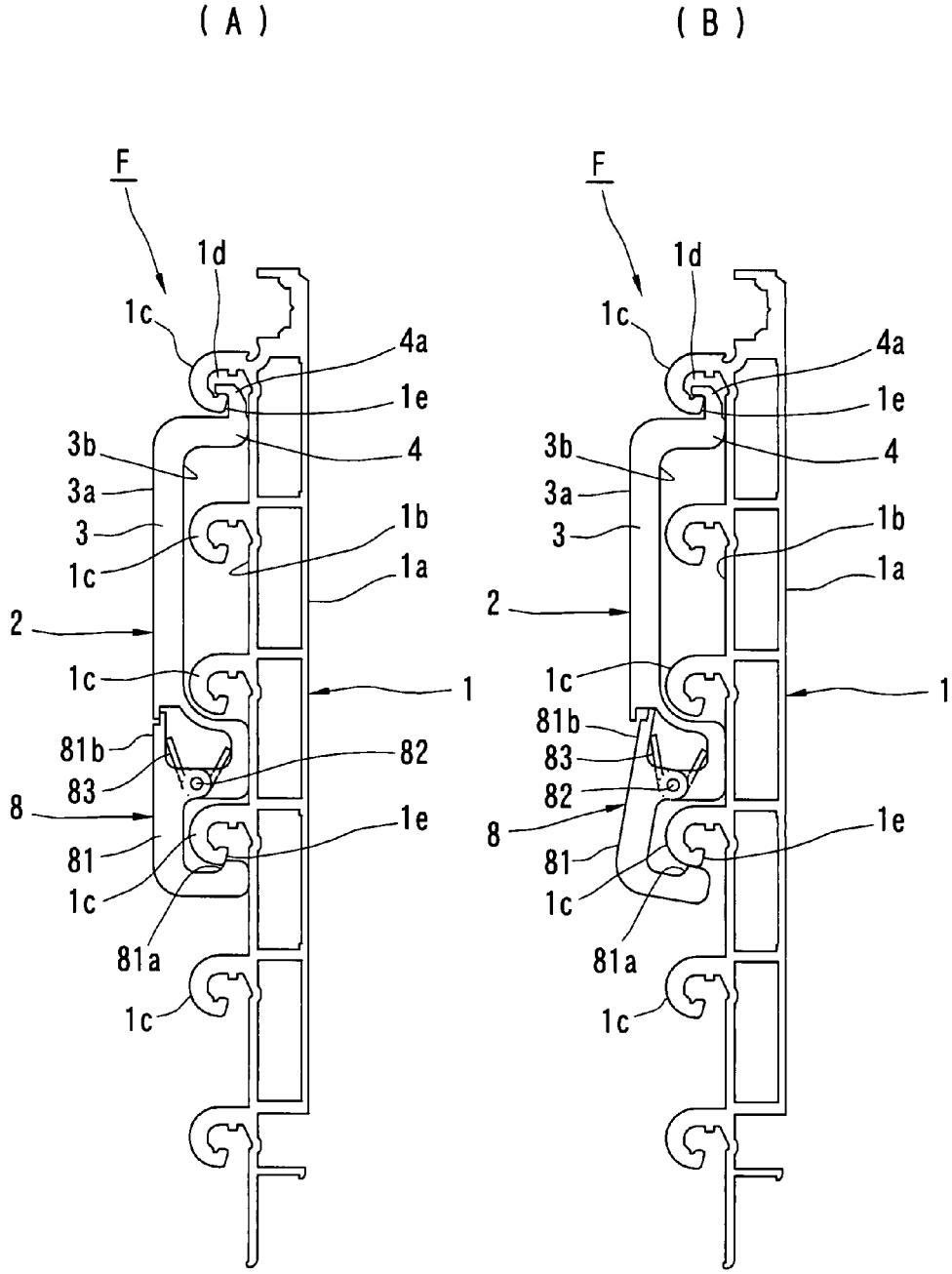
FIG. 8 is a view showing a sixth embodiment of the present invention.

FIG. 8 shows a sixth embodiment of the present invention. A display device F of the sixth embodiment is a modification of the display device B shown in FIG. 3. This display device F is different from the display device B in the respects that it includes no engagement member 7 and that a connection mechanism 8 is provided instead of the second engagement part 5.

The connection mechanism 8 includes a turning member (displacing member) 81. An intermediate part of this turning member 81 is turnably connected to the lower end of the main body part 3 through a shaft 82 extending horizontally in the left and right direction. The turning member 81 is turnable between an engaging position shown in FIG. 8(A) and a releasing position shown in FIG. 8(B). The turning member 81 is turn biased in a direction toward the engaging position from the releasing position by a spring (biasing means) 83. When the turning member 81 is located in the engaging position, an abutment surface 81*a* formed on a lower end of the turning member 81 is pressure-contacted with the tip surface 1*e* of the engagement part 1*c* by biasing force of the spring 83. That is, the turning member 81 is engaged with the engagement part 1*c* by the spring 83. When the turning member 81 is in engagement with the engagement part 1*c*, the engagement claw part 4*a* of the first engagement part 4 and the turning member 81 sandwichingly hold the two engagement parts 1*c*, 1*c*.

A control part 81*b* extending upwardly is disposed at an upper end of the turning member 81. When this control part 81*b* is pushed toward the panel 1, the turning member 81 is turned toward the releasing position from the engaging position against biasing force of the spring 83. When the turning member 81 is located at the releasing position, the abutment surface 81*a* is separated from the tip surface 1*e* of the engagement part 1*c* and engagement between the turning member 81 and the engagement part 1*c* is released.

In order to attach the engagement member 2 including the main body part 3, the first engagement part 4 and the connection mechanism 8 to the panel 1 in the display device F thus constructed, first, the engagement member 2 is brought to the removing position in the same manner as in the above embodiments. At this time, the turning member 81 is turn biased toward the engaging position from the releasing position by the spring 83 and the upper end of the turning member 81 comes into abutment with the lower end of the main body part 3 thereby the turning member 81 is stopped at the same position as the engaging position or at a position slightly beyond the engaging position. When the main body part 3 is turned toward the attaching position from the removing position, the lower end of the turning member 81 is brought into abutment with the outer surface of the engagement part 1*c* during the turning of the main body part 3. Thereafter, when the engagement member 2 is further turned toward the attaching position, the turning member 81 is turned toward the releasing position from the engaging position by the outer surface of the engagement part 1*c* against biasing force of the spring 83. When the engagement member 2 reaches the attaching position, the turning member 81 is turned to the engaging position by the spring 81 and the abutment surface 81*a* is pressure-contacted with the tip surface 1*e*. As a result, the engagement member 2 is attached to the panel 1.

With the engagement member 2 attached to the panel 1, when the control part 81*b* is pushed toward the panel 1, the turning member 81 is turned toward the releasing position from the engaging position against biasing force of the spring 83 and engagement between the turning member 81 and the engagement part 1*c* is released. As a result, the engagement member 2 becomes turnable from the attaching position to the removing position. Thereafter, the engagement member 2 can be removed from the panel 1 in the same manner as in the above embodiments.

Figure 9:
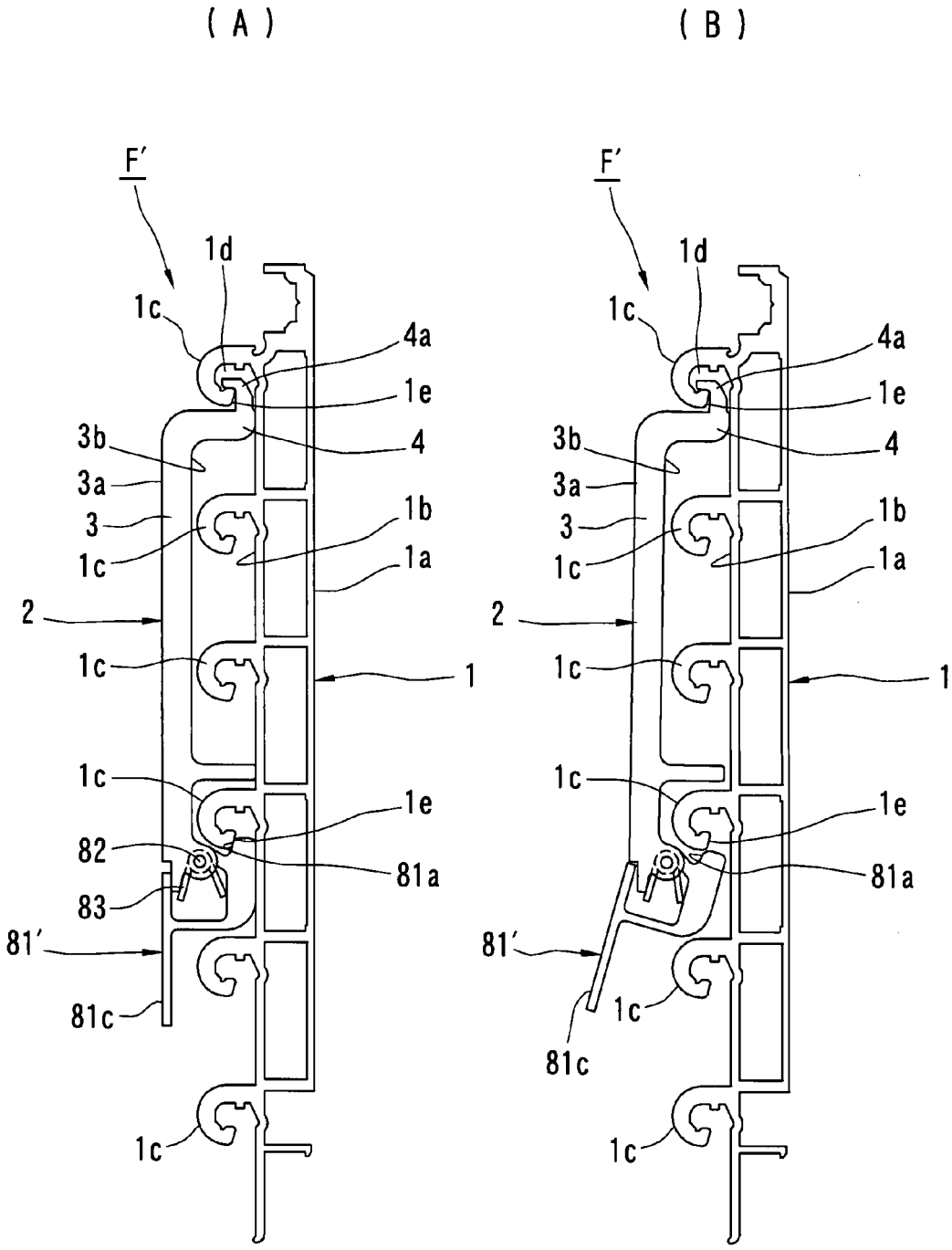
FIG. 9 is a view showing a seventh embodiment of the present invention.

FIG. 9 shows a seventh embodiment of the present invention. A display device F' of the seventh embodiment is a modification of the display device F, and it employs a turning member 81' instead of the turning member 81 of the connection mechanism 8. In this turning member 81', a control part 81c extending downwardly is formed on its lower end. The vertical length of the control part 81' is longer than the distance from a contacting position between the abutment surface 81*a* and the tip surface 1*e* to the center of the shaft 82. Owing to this arrangement, the turning member 81' can easily be turned and the engagement member 2 can easily be removed from the panel 1. Other construction is same as that of the display device F.

Figure 10:
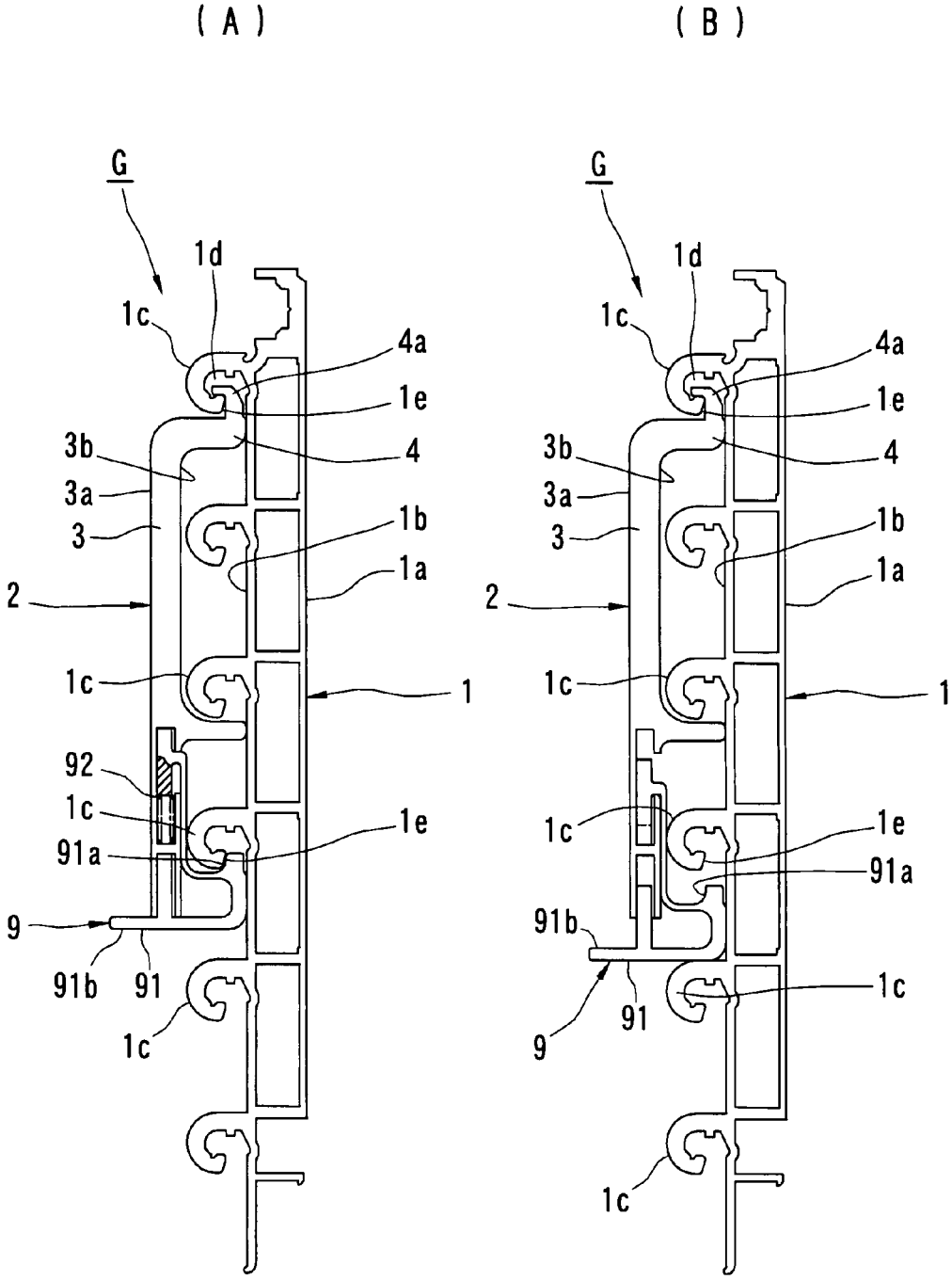
FIG. 10 is a view showing an eighth embodiment of the present invention.

FIG. 10 shows an eighth embodiment of the present invention. A display device G of the eighth embodiment is a modification of the display device F, and it employs a connection mechanism 9 instead of the connection mechanism 8 of the display device F. The connection mechanism 9 includes a movable member (displacing member) 91. This movable member 91 is disposed at the lower end of the main body part 3 in such a manner as to be movable between an engaging position shown in FIG. 10(A) and a releasing position shown in FIG. 10(B). The movable member 91 is biased toward the engaging position from the releasing position by a spring (biasing means) 92. When the movable member 91 is located at the engaging position, an abutment surface 91*a* formed on the movable member 91 is pressure-contacted with the tip surface 1*e* of the engagement part 1*c* by biasing force of the spring 92. That is, the movable member 91 is in engagement with the engagement part 1*c*. When the movable member 91 is engaged with the engagement part 1*c*, the movable member 91 and the engagement claw part 4*a* of the first engagement part 4 sandwichingly hold the two engagement parts 1*c*, 1*c*. When the movable member 91 located at the engaging position is moved toward the releasing position (downwardly) against biasing force of the spring 92, the abutment surface 91*a* is separated from the tip surface 1*e* downwardly. As a result, the engagement member 2 becomes turnable from the attaching position to the removing position. A protrusion part 91*b* protruding forwardly is formed on a lower end of the movable member 91. By pushing this control part 91*b* downwardly by finger, the movable member 91 can be moved from the engaging position to the releasing position against biasing force of the spring 92.

In order to attach the engagement member 2 including the main body part 3, the first engagement part 4 and the connection mechanism 9 to the panel 1 in the display device G thus constructed, the engagement member 2 is brought into the removing position in the same manner as in the above embodiments. At that time, the movable member 91 is biased toward the engaging position from the releasing position by the spring 92 and it is located in the engaging position or in a position slightly beyond the engaging position due to its abutment with the lower end of the main body part 3. When the engagement member 2 is turned from the removing position to the attaching position, the movable member 91 is abutted with the outer surface of the engagement part 1*c* in mid-course of turning. By this, the movable member 91 is moved toward the releasing position from the engaging position in accordance with turning of the engagement member 2. When the engagement member 2 reaches the attaching position, the movable member 91 is moved to the engaging position by the spring 92 and the abutment surface 91*a* is pressure-contacted with the tip surface 1*e*. By doing so, the engagement member 2 is attached to the panel 1. When the abutment surface 91*a* is separated from the tip surface 1*e* downwardly by moving the movable member 91 from the engaging position to the releasing position, the engagement member 2 becomes turnable toward the removing position from the attaching position. Thus, the engagement member 2 can be removed from the panel 1.

Figure 11:
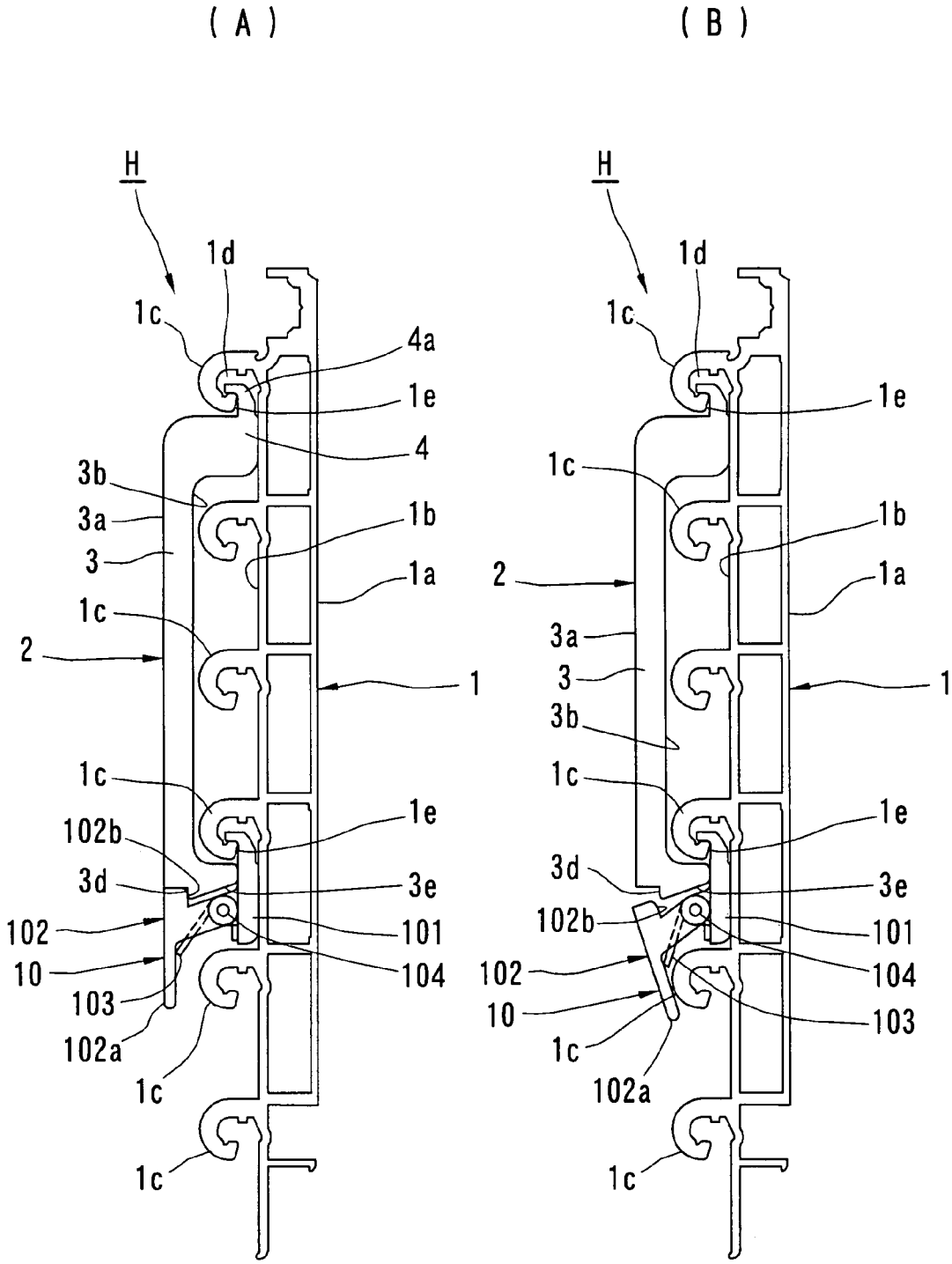
FIG. 11 is a view showing a ninth embodiment of the present invention.

FIG. 11 shows a ninth embodiment of the present invention. In a display device H of the ninth embodiment, the engagement member 2 includes a connection mechanism 10 instead of the connection mechanisms 8, 9. The connection mechanism 10 chiefly comprises a first connection member 101, a second connection member 102 and a spring (turn biasing means) 103.

The first connection member 101 is in a shape obtained by extending the lower end of the engagement claw part 4*a* downwardly by a predetermined length. Accordingly, an upper end of the first connection member 101 can be brought into engagement with the engagement part 1*c* in the same manner as with the engagement claw part 4*a*. With the first connection member 101 engaged with the engagement part 1*c*, the lower end of the first connection member 101 is connected to the panel 1 in such a manner as almost non-movable at least in the back and forth direction and downwardly.

The second connection member 102 is turnably connected at one end thereof to the lower end of the first connection member 101 through a shaft 104 horizontally extending in the left and right direction. The second connection member 102 is turnable between an engaging position shown in FIG. 11(A) and a releasing position shown in FIG. 11(B). The second connection member 102 is turn biased toward the engaging position from the releasing position by the spring 103. A control part 102*a* protruding downwardly is formed on the lower end of the second connection member 102. When this control part 102*a* is pushed toward the panel 1, the second connection member 102 is turned toward the releasing position from the engaging position against biasing force of the spring 103.

When the second connection member 102 is brought to the engaging position, an abutment surface 102*b* formed on an intermediate part of the second connection member 102 comes into abutment with the abutment surface 3*d* formed on the lower end of the main body part 3 and the lower end of the main body part 3 is pushed against the first connection member 101 by biasing force of the spring 103. As a result, the lower end of the main body part 3 is brought into engagement with the engagement part 1*c* through the first connection member 101 and connected to the panel 1 in such a manner as almost non-movable at least in the back and forth direction and downwardly. When the second connection member 102 is turned from the engaging position to the releasing position by pushing the control part 102*a* toward the panel 1, the abutment surface 102*b* is separated from the abutment surface 3*d* of the main body part 3, so that the lower end of the main body part 3 becomes movable forwardly and the main body part 3 becomes turnable from the attaching position to the removing position. The attaching position and the removing position of the main body part 3 are same as the corresponding positions of the main body part 3 of the engagement member 2 when the engagement member 2 is brought into the attaching positions and the removing positions in the above embodiments.

In order to attach the engagement member 2 to the panel 1 in the display device H thus constructed, the main body part 3 is brought into the removing position and the first connection member 101 is brought into engagement with the engagement part 1*c*. At that time, the second connection member 102 is biased toward the engaging position from the releasing position by the spring 103 and it is located at the engaging position or a position slightly beyond the engaging position by a stopper mechanism (not shown) disposed between the first connection member 101 and the second connection member 102. When the main body part 3 is turned toward the attaching position from the removing position, an inclination surface 3*e* formed on the lower end surface of the main body part 3 is abutted with the second connection member 102 during the turning of the main body part 3 and the second connection member 102 is turned toward the releasing position. When the main body part 3 is turned to the attaching position, the lower end of the main body part 3 is brought into abutment with the first connection member 101 and the second connection member 102 is turned from the releasing position to the engaging position by the spring so that its abutment surface 102*b* is abutted with the abutment surface 3*d* of the main body part 3 to push the lower end of the main body part 3 against the first connection member 101. By doing so, the engagement member 2 is attached to the panel 1.

In order to remove the engagement member 2 from the panel 1, the control part 102*a* is pushed toward the panel 1 and the second connection member 102 is turned from the engaging position to the releasing position. Thereafter, the main body part 3 is turned from the attaching position to the removing position. Then, the main body part 3 is moved downwardly to remove the panel 1. By doing so, the entire engagement member 2 is removed from the panel 1.

The present invention should not be limited to the above embodiments but many changes and modifications, if necessary, can be made without departing from the gist of the invention.

For example, in the above embodiments, the tip part of the engagement part 1*c* is formed in such a manner as to be bent downwardly in the shape of a semi-circle. However, it is also accepted that the tip part of the engagement part 1*c* is bent upwardly in the shape of a semi-circle. In that case, by using the engagement member 2 in an upside down posture, the engagement member 2 can be removably attached to the panel 1.

INDUSTRIAL APPLICABILITY

The engagement member according to the present invention can be used in a display device for displaying clothes and the like.

The invention claimed is:

1. An engagement member for a display device comprising:

a main body part having a predetermined length in a vertical direction, an engagement part disposed at a first vertical end of said main body part and removably engaged with a front surface part of a base material, and connection means for removably elastically connecting a second vertical end of said main body part to the front surface of said base material, wherein when the main body part is rotated about the engagement part such that the second vertical end approaches the front surface of the base material, the connection means removably elastically connects the second vertical end to the front surface of the base material, and one of said main body part and said connection means is provided with a control part manually controlled for releasing connection of said connection means with said base material.

2. An engagement member for a display device according to claim 1, wherein said connection means is disposed at the second vertical end of said main body part.

3. An engagement member for a display device according to claim 2, wherein said connection means is an elastic element integrally disposed at said main body part, said elastic element is removably connected to said base material by elasticity of the base material, whereby the second vertical end of said main body part is elastically removably engaged with said base material, and said control part is integrally disposed at said main body part.

4. An engagement member for a display device according to claim 3, wherein at least a tip part of said control part is disposed forward of a position where said elastic element is engaged with said base material in a direction toward said elastic element from said engagement part.

5. An engagement member for a display device according to claim 1, wherein said connection means includes:

a displacement member disposed at said main body part such that said displacement member is displaceable between an engaging position where said main body part is engaged with said base material, and a releasing position away from said base material, and biasing means for biasing said displacement member toward the engaging position from the releasing position, wherein said displacement member is brought into engagement with the base material by biasing force of said biasing means, whereby the second vertical end of said main body part is elastically removably connected to said base material, and said displacement member is provided with said control part.

6. An engagement member for a display device according to claim 1, wherein said connection means includes:

a first connection member removably engaged with said base material, a second connection member disposed at said first connection member such that said second connection member is turnable between a first turning position where said second connection member is engaged with said main body part, and a second turning position away from said main body part, and a turn biasing means for biasing said second connection member toward the first turning position from the second turning position, wherein said second connection member is brought into engagement with said main body part by biasing force of said turn biasing means, whereby the second vertical end of said main body part is elastically removably connected to said base material, and said second connection member is provided with said control part.

* * * * *